US011525339B2

(12) United States Patent
Jeronimo et al.

(10) Patent No.: US 11,525,339 B2
(45) Date of Patent: Dec. 13, 2022

(54) EXTENDED ENTRY PORT SHUNTING SYSTEM

(71) Applicant: Schlumberger Technology Corporation, Sugar Land, TX (US)

(72) Inventors: Ernani Jeronimo, Baku (AZ); Marcelo Oblitas Ruiz, Baku (AZ); Abdulali Aliyev, Moscow (RU); Carlos Emilio Webel, Baku (AZ); Michael Dean Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/252,308

(22) PCT Filed: Jun. 25, 2019

(86) PCT No.: PCT/US2019/038901

§ 371 (c)(1),
(2) Date: Dec. 15, 2020

(87) PCT Pub. No.: WO2020/005883

PCT Pub. Date: Jan. 2, 2020

(65) Prior Publication Data

US 2021/0262323 A1 Aug. 26, 2021

Related U.S. Application Data

(60) Provisional application No. 62/689,639, filed on Jun. 25, 2018.

(51) Int. Cl.

| | |
|---|---|
| ***E21B 43/04*** | (2006.01) |
| ***E21B 17/02*** | (2006.01) |
| ***E21B 43/08*** | (2006.01) |

(52) U.S. Cl.
CPC ..... *E21B 43/04* (2013.01); *E21B 17/02* (2013.01); *E21B 43/08* (2013.01)

(58) Field of Classification Search
CPC ..... E21B 43/04; E21B 17/02; E21B 43/08
See application file for complete search history.

(56) References Cited

U.S. PATENT DOCUMENTS 7,207,383 B2 4/2007 Hurst et al.
7,370,700 B2 5/2008 Hurst et al.
(Continued)

FOREIGN PATENT DOCUMENTS

WO 2006076526 A1 7/2006

OTHER PUBLICATIONS

International Preliminary Report on Patentability of International Patent Application No. PCT/US2019/038901 dated Dec. 29, 2020, 6 pages.

(Continued)

*Primary Examiner* — Taras P Bemko
(74) *Attorney, Agent, or Firm* — Matthew Goode

(57) ABSTRACT

A technique facilitates a gravel packing operation in a well. The system may utilize a Y-manifold having a manifold body through which or along which a gravel slurry may be flowed. A plurality of exit end shunt connectors extends from the manifold body to enable connection with corresponding exit end shunt tubes at a position separated from the manifold body. Additionally, a plurality of entrance end shunt connectors extends from the manifold body in a direction generally opposite the exit end shunt connectors. The extended entrance end shunt connectors enable connection with corresponding entrance end shunt tubes at a position separated from the manifold body.

8 Claims, 7 Drawing Sheets

(56) References Cited

U.S. PATENT DOCUMENTS

| | | | | |
|---|---|---|---|---|
| 2006/0219404 | A1* | 10/2006 | Coronado | E21B 43/04 166/278 |
| 2007/0131421 | A1 | 6/2007 | Hurst et al. | |
| 2008/0128129 | A1 | 6/2008 | Yeh et al. | |
| 2012/0168159 | A1 | 7/2012 | Edwards et al. | |
| 2014/0332211 | A1 | 11/2014 | Cunningham et al. | |

OTHER PUBLICATIONS

International Search Report and Written Opinion issued in the PCT Application PCT/US2019/038901 dated Oct. 14, 2019 (11 pages).
ALLFRAC—Alternate Path cased-hole frac-pack screens, 2014 (2 pages).

* cited by examiner

EXTENDED ENTRY PORT SHUNTING SYSTEM

CROSS-REFERENCE TO RELATED APPLICATION

This application is based on and claims priority to U.S. Provisional Application Ser. No. 62/689,639, filed Jun. 25, 2018, which is incorporated herein by reference in its entirety.

BACKGROUND

Gravel packs are used in wells for removing particulates from inflowing hydrocarbon fluids. In a variety of applications, gravel packing is performed in long horizontal wells by pumping gravel slurry, e.g. gravel suspended in a carrier fluid, down the annulus between the wellbore and a screen assembly. The carrier fluid is returned to the surface after depositing the gravel in the wellbore annulus. To return to the surface, the carrier fluid flows through the screen assembly, through base pipe perforations, and into a production tubing which routes the returning carrier fluid back to the surface. Alternate path systems are sometimes used to help form a desirable gravel pack. The alternate path systems utilize various types of shunt tubes, which help distribute the gravel slurry.

In various operations, alternate path systems are used to facilitate open hole gravel packs. In such alternate path open hole gravel packs, the shunt tubes, e.g. transport tubes, provide a secondary flow path to carry the gravel slurry to the open hole section being gravel packed in case of a partial blockage that prevents the gravel slurry from being carried along the primary circulation path during the open hole gravel pack. Entry ports for the shunt tubes are normally at the entrance of a Y-manifold or other suitable component. The sequential sections of shunt tubes are connected to each other between the different components of the completion of equipment (e.g between shunted screen joints, shunted blank pipes, Y-manifolds) by sections of shunt tubes referred to as jumper tubes. The jumper tubes may be used to form such connections from, for example, the Y-manifold to the bottom of the screen assemblies to cover the entire open hole section. If, however, this secondary flow path becomes plugged or otherwise fails to activate, the result may be an incomplete gravel pack in the well. The incomplete gravel pack may impact production of well fluid or even lead to well integrity problems due to sand production.

SUMMARY

In general, a system and methodology are provided for facilitating a gravel packing operation in a well. According to an embodiment, the system may utilize a Y-manifold having a manifold body through which or along which a gravel slurry may be flowed. A plurality of exit end shunt connectors extends from the manifold body to enable connection with corresponding exit end shunt tubes at a position separated from the manifold body. Additionally, a plurality of entrance end shunt connectors extends from the manifold body in a direction generally opposite the exit end shunt connectors. The extended entrance end shunt connectors enable connection with corresponding entrance end shunt tubes at a position separated from the manifold body. By forming the entrance end connection at a position separated from the manifold body, the risk of forming a plug along the alternate flow path is substantially reduced.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate a gravel packing operation in a well. The technique enables use of, for example, shunted blank pipes on both ends of a manifold, e.g. on the bottom and the top of a manifold, used in an alternate path gravel packing operation.

According to an embodiment, the system may utilize a Y-manifold having a manifold body through which or along which a gravel slurry may be flowed. A plurality of exit end shunt connectors extends from the manifold body to enable connection with corresponding exit end shunt tubes at a position separated from the manifold body. Additionally, a plurality of entrance end shunt connectors extends from the manifold body in a direction generally opposite the exit end shunt connectors. The extended entrance end shunt connectors enable connection with corresponding entrance end shunt tubes at a position separated from the manifold body.

By forming the entrance end connection at a position separated from the manifold body, the risk of forming a plug along the alternate flow path is substantially reduced. For example, in some applications the extended entrance end shunt connectors of the Y-manifold may be connected with an ALLFRAC blank pipe (available from Schlumberger), thus effectively distancing the shunting entry ports from the main body of the Y-manifold. This distance helps reduce blocking/plugging of the alternate path transport tubes which increases the chances of a complete gravel pack in the well. This type of embodiment effectively forms an extended entry ports shunting system with a double end shunts connection Y-manifold.

Figure 1:
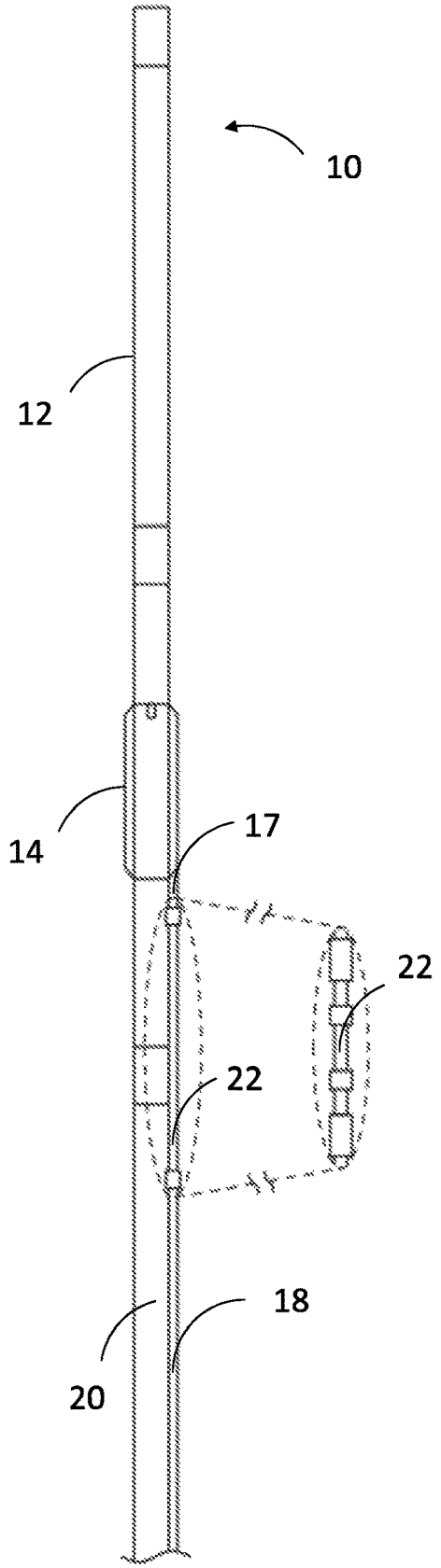
FIG. 1 is an illustration of a standard equipment configuration used to facilitate formation of a gravel pack.
Figure 2:
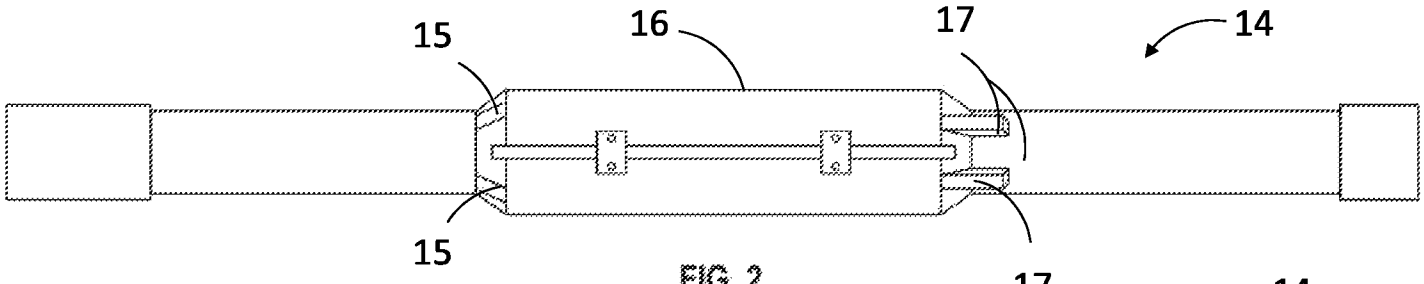
FIG. 2 is a top view of a standard Y-manifold.
Figure 3:
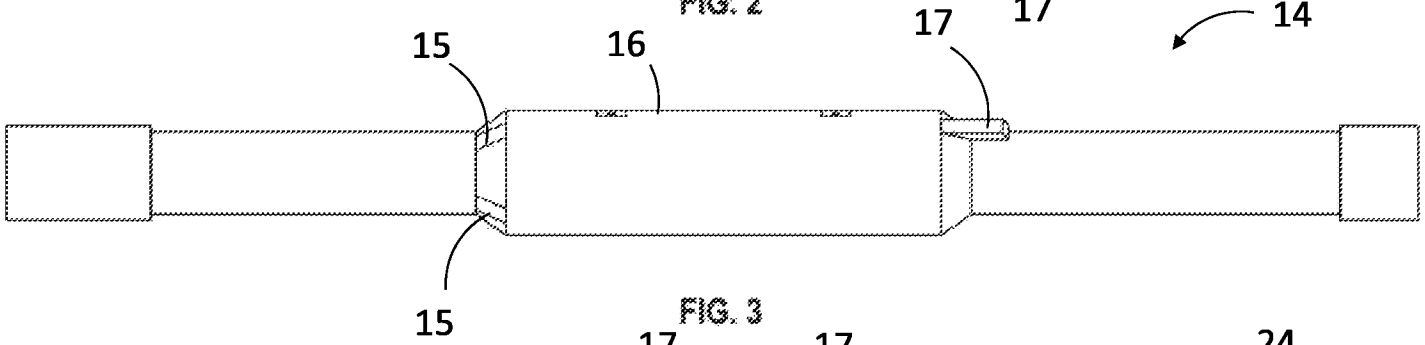
FIG. 3 is a side view of the standard Y-manifold illustrated in FIG. 2.
Figure 4:
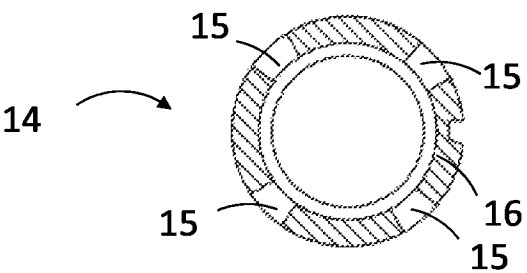
FIG. 4 is a cross-sectional illustration taken at an entrance of the Y-manifold illustrated in FIG. 3.
Figure 7:
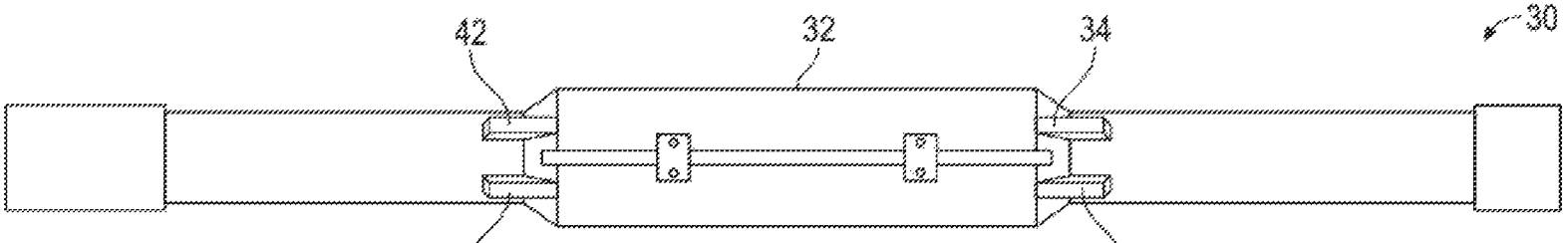
FIG. 7 is a top view of a double end shunts connection Y-manifold, according to an embodiment of the disclosure.
Figure 8:
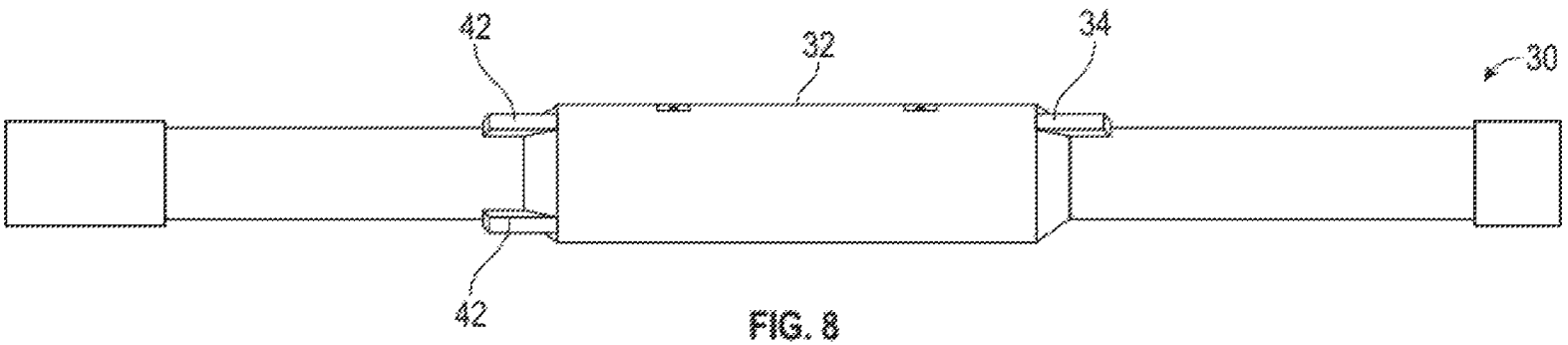
FIG. 8 is a side view of the double end shunts connection Y-manifold illustrated in FIG. 7, according to an embodiment of the disclosure.

Referring generally to FIGS. 1-6, an example of a standard alternate path open hole gravel packing system 10 is illustrated to facilitate an understanding of the blocking/plugging risk associated with standard systems. As illustrated in FIG. 1, a standard blank pipe 12 is connected above the standard Y-manifold 14. The standard Y-manifold 14 has a gravel slurry entrance formed by entry ports 15 in the main body 16 of the standard Y-manifold 14, as illustrated in FIGS. 2-4.

Figure 5:
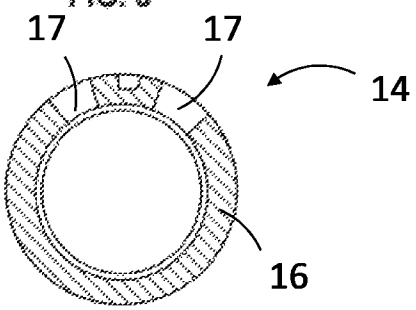
FIG. 5 is a cross-sectional illustration taken at an exit of the Y-manifold illustrated in FIG. 3.

During a standard gravel packing operation, the gravel slurry travels along, e.g. through, the standard Y-manifold 14 and exits through bottom connectors 17, which extend from the main body of the standard Y-manifold 14, as illustrated in FIGS. 2, 3 and 5. With additional reference to FIG. 1, the gravel slurry travels to transport tubes 18 of a shunted blank pipe 20 via jumper tubes 22 coupled between the bottom connectors 17 and the transport tubes 18. With this configuration, however, the entrance to the shunting system is simply at the face of the standard Y-manifold 14, which creates a reduced area open to flow 24, as illustrated in FIG. 6.

Figure 6:
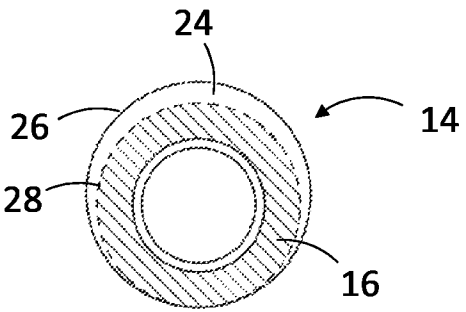
FIG. 6 is a cross-sectional illustration of the standard Y-manifold disposed within a casing to show the reduced area open to flow at the entrance of the shunting system which tends to increase the risk of plugging during gravel packing.

In fact, due to the limited clearance between the surrounding casing 26 and the outer diameter (OD) 28 of the standard Y-manifold 14 as shown in FIG. 6, the area open to flow 24 of the gravel slurry is substantially reduced just at the entrance of the shunting system. This mechanical restriction can lead to gravel deposition at the face of the standard Y-manifold 14. The gravel deposition considerably increases the chances of plugging/blocking the entrance of one or more shunting transport tubes which can lead to an unsuccessful gravel pack job.

Referring generally to FIGS. 7-10, an embodiment is illustrated which is able to overcome this potential failure mode. According to this embodiment, a Y-manifold 30 is provided in the form of a double end shunts connection Y-manifold, which has extended entry ports. In this example, the Y-manifold 30 has a main manifold body 32 along which, e.g. through which, the gravel slurry is able to flow during gravel packing of a wellbore.

Figure 11:
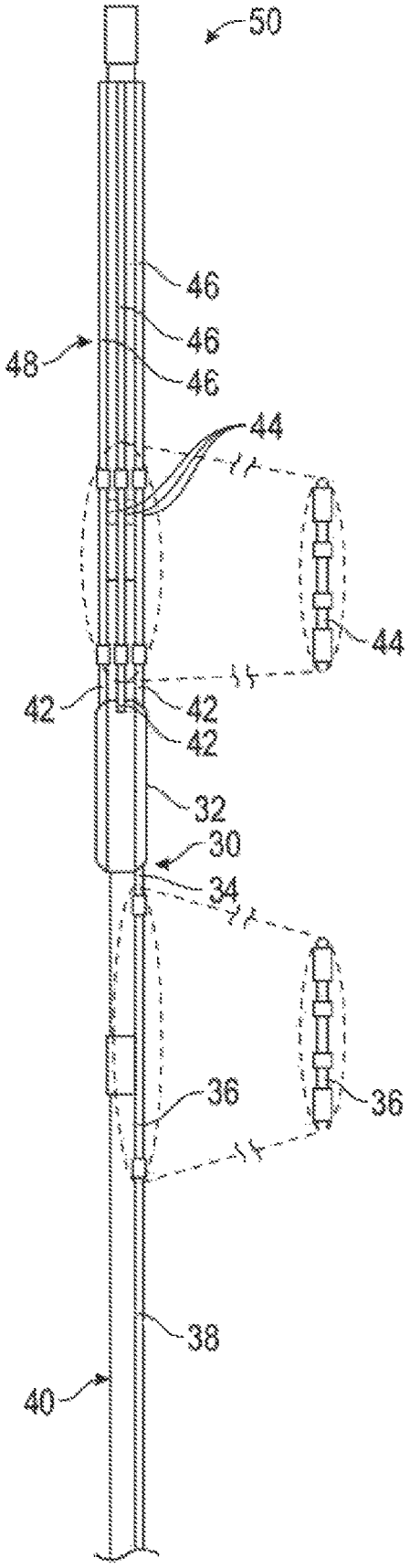
FIG. 11 is an illustration of the double end shunts connection Y-manifold disposed in a gravel packing shunt tube system, according to an embodiment of the disclosure.

A plurality of exit end shunt connectors 34 extends from the body 32 to enable connection with corresponding exit end shunt tubes, e.g. jumper tubes 36 coupled with corresponding transport tubes 38 of a shunted blank pipe 40, as illustrated in FIG. 11. The coupling between the exit end shunt connectors 34 and the corresponding exit end shunt tubes, e.g. jumper tubes 36, occurs at a position separated from the manifold body 32.

Additionally, a plurality of entrance end shunt connectors 42 extends from the body 32 to enable connection with corresponding entrance end shunt tubes, e.g. jumper tubes 44 coupled with corresponding shunt tubes 46. The corresponding shunt tubes 46 may be transport tubes of a shunted blank pipe 48, as further illustrated in FIG. 11. By way of example, the shunted blank pipe 48 may be in the form of an ALLFRAC blank pipe available from Schlumberger company. The coupling between the entrance end shunt connectors 42 and the corresponding entrance end shunt tubes, e.g. jumper tubes 44, occurs at a position separated from the manifold body 32. It should be noted the plurality of entrance end shunt connectors 42 may be in fluid communication with the plurality of exit end shunt connectors 34 via conduits extending through the main manifold body 32.

Figure 10:
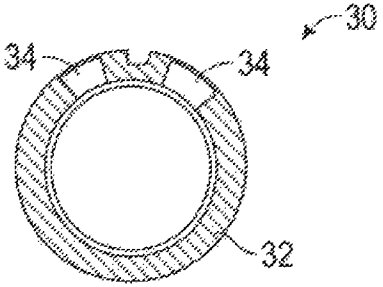
FIG. 10 is a cross-sectional view taken at the exit of the double end shunts connection Y-manifold illustrated in FIG. 8, according to an embodiment of the disclosure.
Figure 9:
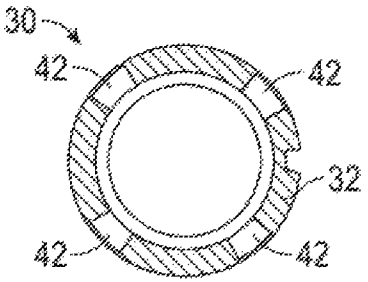
FIG. 9 is a cross-sectional view taken at the entrance of the double end shunts connection Y-manifold illustrated in FIG. 8, according to an embodiment of the disclosure.
Figure 12:
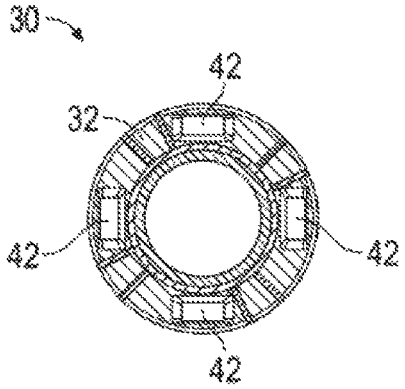
FIG. 12 is a cross-sectional view taken generally at the entrance of the double end shunts connection Y-manifold illustrated in FIG. 11, according to an embodiment of the disclosure.

FIG. 11 effectively illustrates an embodiment of an overall extended entry ports shunting system 50 with a double end shunts connection Y-manifold 30. According to the illustrated embodiment, the plurality of exit end shunt connectors 34 may comprise two exit end shunt connectors 34, as shown in FIG. 10, for example, although other numbers may be utilized. As further illustrated, the plurality of entrance end shunt connectors 42 may comprise four entrance end shunt connectors 42, as illustrated in FIGS. 9 and 12, although other numbers may be utilized.

Figures 13A, 13B, 13C:
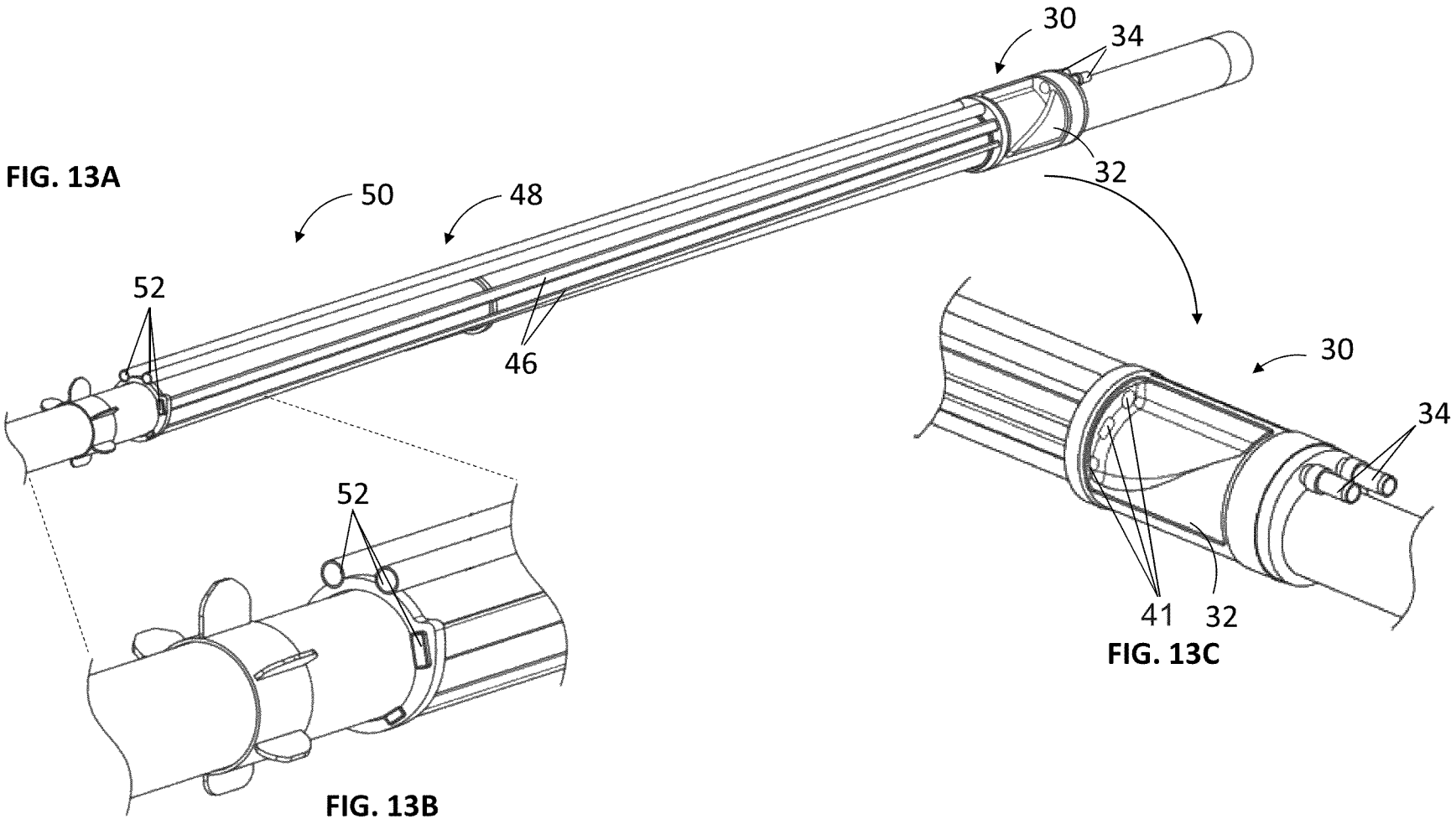
FIG. 13A is a perspective view of a Y manifold disposed in a gravel packing shunt tube system, according to an embodiment of the disclosure.
FIG. 13B is a zoomed in view of alternate path entrances of the gravel packing shunt tube system shown in FIG. 13A, according to an embodiment of the disclosure.
FIG. 13C is a zoomed in view of the Y manifold shown in FIG. 13A, according to an embodiment of the disclosure.

Referring now to FIG. 13A, a perspective view of a Y-manifold disposed in a gravel packing shunt tube system, according to one or more embodiments of the present disclosure is shown. Specifically, FIG. 13A shows another embodiment of an extended entry port shunting system 50 including a shunted blank pipe 48 with a plurality of shunt tubes 46 having a plurality of alternate path entrances 52. A zoomed in view of the plurality of alternate path entrances 52 is shown in FIG. 13B. As shown in FIG. 13A, the plurality of shunt tubes 46 are affixed along a length of the shunted blank pipe 48, according to one or more embodiments of the present disclosure, such as by welding, for example, as further described below. Referring now to FIGS.

13A and 13C, a Y-manifold 30 according to one or more embodiments of the present disclosure is also shown. As further shown in FIGS. 13A and 13C, the plurality of shunt tubes 46 have second ends 41 opposite the ends having the alternate path entrances 52 that exit into the body 32 of the Y-manifold 30. Because of the full circumferential coverage of the plurality of alternate path entrances 52, the chances of getting the entrances 52 of the shunts system plugged by gravel deposition on the face of the Y-manifold 30 is substantially decreased. FIG. 13C clearly shows the second ends 41 of the plurality of shunt tubes 46 exiting into the body 32 of the Y-manifold 30 and exit end shunt connectors 34 extending from the body 32 to enable connection with corresponding exit end shunt tubes, e.g., jumper tubes 36 for coupling with corresponding transport tubes 38 (not shown), blank pipe, or a screen system, such as a 2×2 OptiPac screen system, for example (FIG. 14).

According to one or more embodiments of the present disclosure, FIG. 13A shows that the plurality of shunt tubes 46 may be twisted along the length of the shunted blank pipe 48. In one or more embodiments, the plurality of shunt tubes 46 may be welded to the Y-manifold 30, extend along the shunted blank pipe 48 in an uphole direction, and twist around the shunted blank pipe 48 to achieve full circumference spacing for slurry entry into the extended entry port shunting system 50. Further, FIGS. 13A-13C show that the plurality of shunt tubes 46, including the plurality of alternate path entrances 52 and the plurality of exit ends 41, may be progressively smaller shunt tubes 46, i.e., progressively decrease in flow through area, to accommodate the eccentric configuration of the extended entry port shunting system 50.

Figure 14:
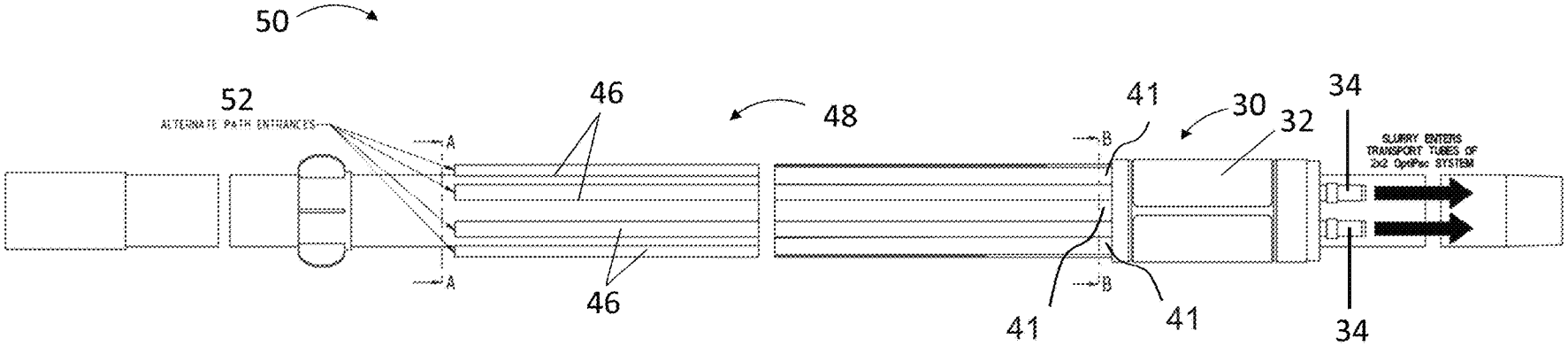
FIG. 14 is an illustration of the Y manifold disposed in the gravel packing shunt system, according to an embodiment of the disclosure.

Referring now to FIG. 14, an illustration of the Y manifold disposed in the gravel packing shunt system, according to an embodiment of the present disclosure is shown. Similar to FIG. 13A, FIG. 14 shows an extended entry port shunting system 50 including a shunted blank pipe 48 with a plurality of shunt tubes 46 having a plurality of alternate path entrances 52. A Y-manifold 30 according to one or more embodiments of the present disclosure is also shown. As further shown in FIG. 14, the plurality of shunt tubes 46 include ends 41 that exit into the body 32 of the Y-manifold. Because of the full circumferential coverage of the plurality of alternate path entrances 52, the chances of getting the entrances 52 of the shunts system plugged by gravel deposition on the face of the Y-manifold 30 is substantially decreased. FIG. 14 also shows exit end shunt connectors 34 extending from the body 32 to enable connection with corresponding exit end shunt tubes, e.g., jumper tubes 36 for coupling with corresponding transport tubes 38 (not shown), blank pipe, or a screen system, such as the 2×2 OptiPac screen system, for example. Indeed, during gravel packing, the slurry may enter the transport tubes of a 2×2 OptiPac system, for example, as further described below.

Figure 15:
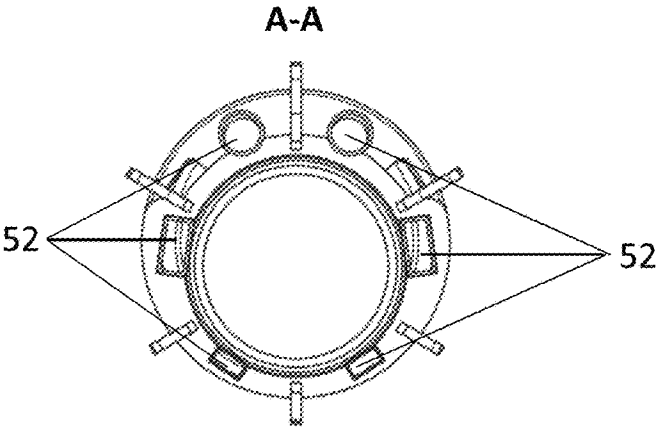
FIG. 15 is a cross-section view taken near the alternate path entrances of the gravel packing shunt tube system along A-A shown in FIG. 14, according to an embodiment of the disclosure.

Referring now to FIG. 15, a cross-section view taken near the alternate path entrances of the gravel packing shunt tube system along A-A shown in FIG. 14, according to one or more embodiments of the present disclosure is shown. As shown, the cross-section view of FIG. 15 more clearly depicts the plurality of alternate path entrances 52 referred to with respect to FIGS. 13A and 13B. Indeed, as more clearly shown in FIG. 15, the plurality of alternate path entrances 52 spaced around the annulus may be associated with progressively smaller shunt tubes 46 to accommodate the eccentric configuration of the extended entry port shunting system 50. For example, as shown in FIG. 15, the alternate path entrances 52 near the bottom of the cross-section of the shunted blank pipe 48 are smaller than the alternate path entrances 52 closer to the top of the cross-section of the shunted blank pipe 48. As such, FIG. 15 shows that the full circumferential coverage of the alternate path entrances 52 minimizes the chance of blocking an entrance 52 into a transport tube. Moreover, FIG. 15 shows how decreasing tube size enables full circumferential coverage.

Figure 16:
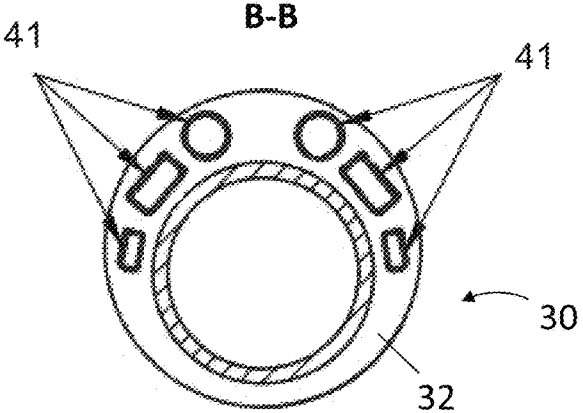
FIG. 16 is a cross-section view taken near the entrance of the Y manifold along B-B shown in FIG. 14, according to an embodiment of the disclosure.

Referring now to FIG. 16, a cross-section view taken near the entrance of the Y manifold along B-B shown in FIG. 14, according to one or more embodiments of the present disclosure is shown. As shown, the cross-section view of FIG. 16 more clearly depicts the second ends 41 of the plurality of shunt tubes 46 exiting into the body 32 of the Y-manifold 30 as described with respect to FIG. 13C. As further shown in FIG. 16, the second ends 41 of the plurality of shunt tubes 46 exiting into the body 32 of the Y-manifold 30 may be associated with progressively smaller shunt tubes 46 to accommodate the eccentric configuration of the extended entry port shunting system 50. Further, the placement of the second ends 41 of the plurality of shunt tubes 46 exiting into the body 32 of the Y-manifold 30, as shown in FIG. 16, further illustrates the twisted configuration of the plurality of shunt tubes 46 along the shunted blank pipe 48 when compared with the placement of the plurality of alternate path entrances 52 spaced around the annulus as shown in FIG. 15, for example.

Figure 17A:
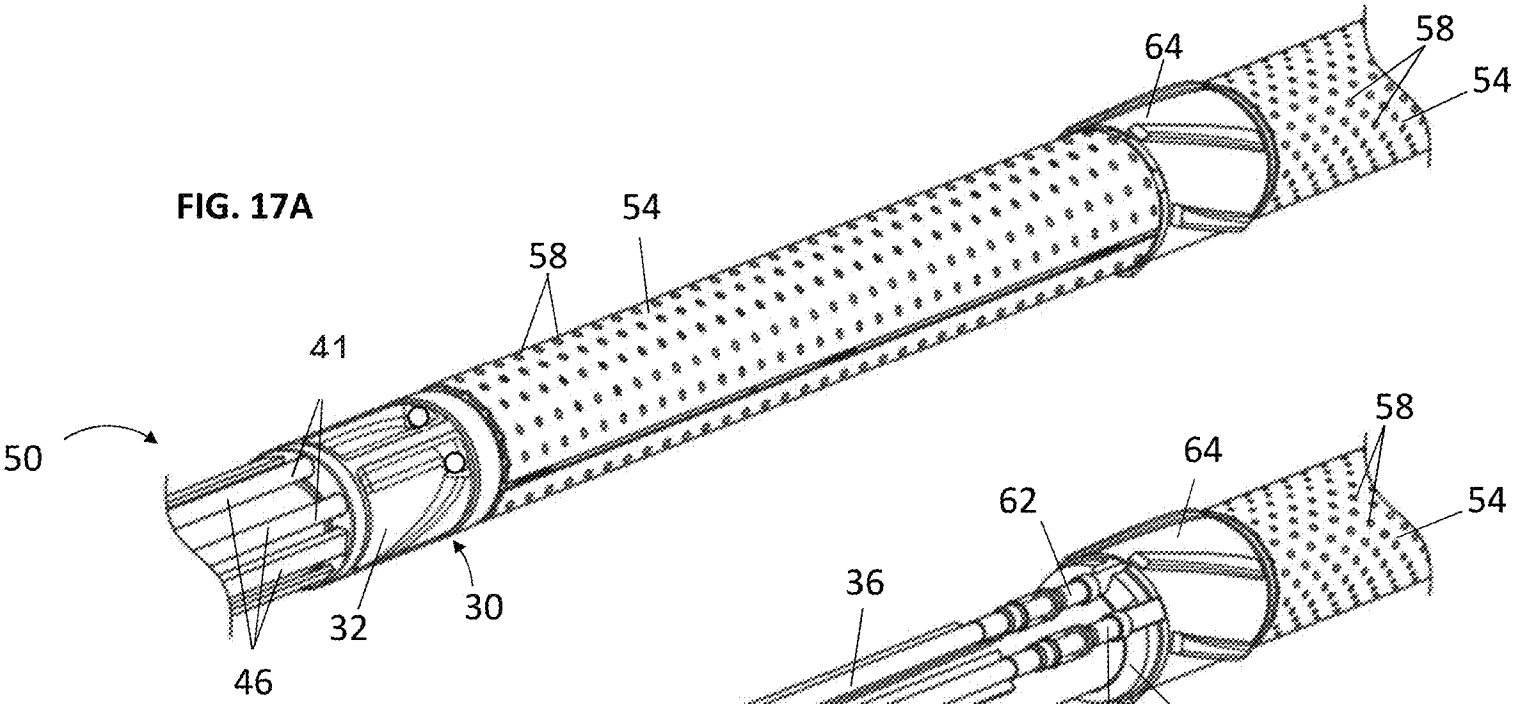
FIG. 17A is a perspective view of a Y manifold disposed in a gravel packing shunt tube system made up with an OptiPac XL shunted blank pipe and covered with a shroud, according to an embodiment of the disclosure.
Figure 17B:
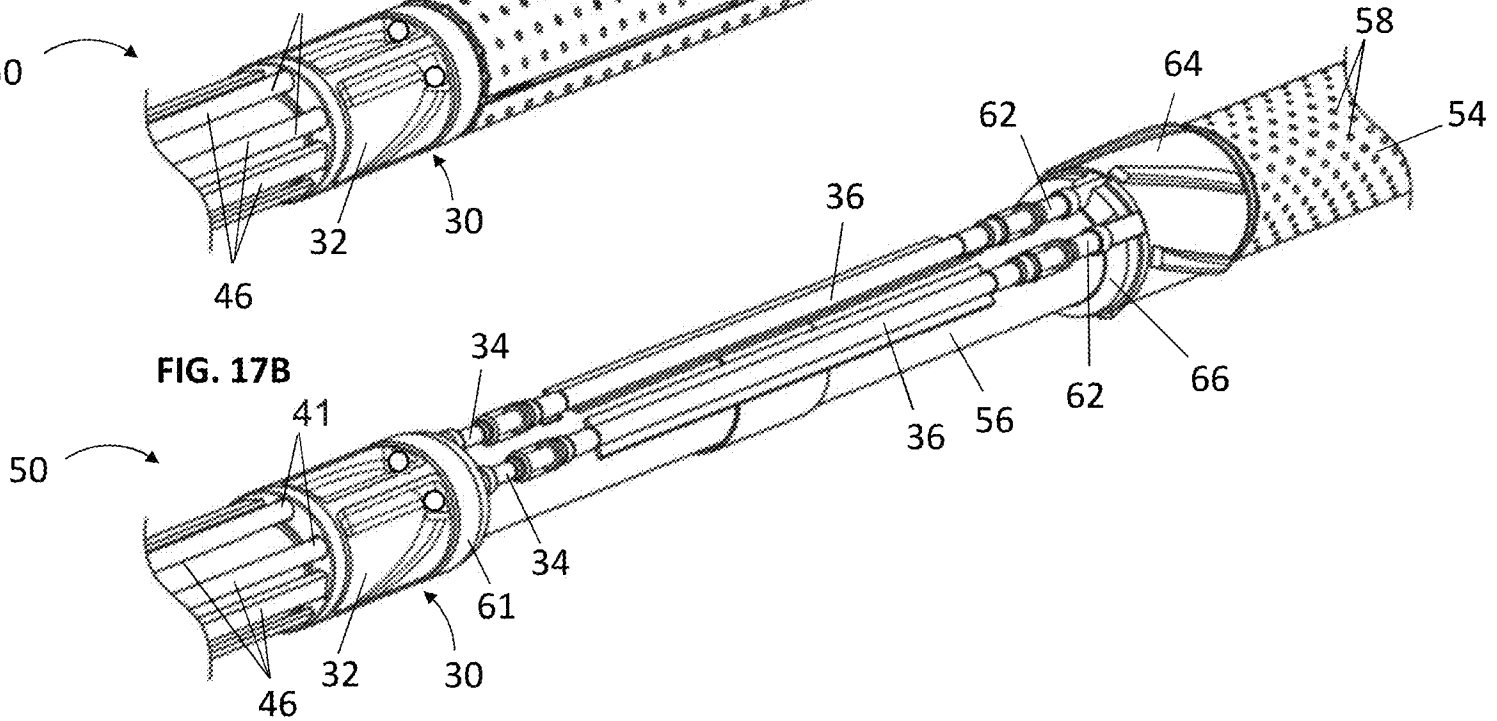
FIG. 17B is the perspective view of the Y manifold disposed in the gravel packing shunt tube system made up with the OptiPac XL shunted blank pipe of FIG. 17A with the shroud removed, according to an embodiment of the disclosure.

Referring now to FIG. 17A, a perspective view of the Y manifold disposed in the gravel packing shunt tube system made up with an OptiPac XL shunted blank pipe and covered with a shroud, according to one or more embodiments of the present disclosure is shown. Further, FIG. 17B shows the perspective view of FIG. 17A with the shroud removed between the joint connection, according to one or more embodiments of the present disclosure. Specifically, FIGS. 17A and 17B show how the slurry may enter the transport tubes of a screen system, such as the 2×2 OptiPac system as previously described with respect to FIG. 14, for example. According to one or more embodiments of the present disclosure, the 2×2 OptiPac system is a shunt system having two transport tubes and two packing tubes for use during a gravel packing operation. As shown, FIGS. 17A and 17B show an extended entry port shunting system 50 according to one or more embodiments of the present disclosure having a plurality of alternate path shunt tubes 46 and the associated second ends 41 of the plurality of shunt tubes 46 exiting into the body 32 of the Y-manifold 30 as previously described with respect to FIG. 16. In some embodiments, a shroud 54 may be positioned around the OptiPac XL shunted blank pipe 56. Each shroud 54 may contain perforations 58 to accommodate fluid flow therethrough. Sequential joints may be connected together via a suitable coupler, e.g. a box and pin end style connection.

As more specifically shown in FIG. 17B, exit end shunt connectors 34 extending from the body 32 of the Y-manifold 30 via a pin end 61 of the joint enable connection with corresponding exit end shunt tubes, e.g., jumper tubes 36 coupled with corresponding transport tubes (not shown) through a transport tube section 62 that feeds into another joint via a box end 66 of the joint. As shown in FIG. 17B, the system may include a centralizer 64 affixed to the box end 66 to facilitate running the assembly downhole, for example. As further shown in FIG. 17B, jumper tubes 36 may traverse the OptiPac XL shunted blank pipe 56 longitudinally. These jumper tubes 36 facilitate the transport of the slurry from the Y-manifold 30 to the transport tubes of the 2×2 OptiPac system. In one or more embodiments of the present disclosure, the Y-manifold 30 may be configured to have two independent commingling volumes, where each volume feeds into one of two transport tubes of the 2×2 OptiPac system. In other embodiments of the present disclosure, the Y-manifold 30 may be configured to have a single commingling volume, which feeds into both transport tubes of the 2×2 OptiPac system.

During gravel packing operations, the use of extended entry ports shunting system 50 with the Y manifold 30 according to one or more embodiments of the present disclosure decreases the chances of having the shunts/transport tubes blocked/plugged during execution of the gravel pack pumping operations. The decreased chance of blocking/plugging is because the shunting entry ports will be spaced out from the main body 32 of the Y-manifold 30 by shunted blank pipe 48. By moving the entrance for the shunts system away from the Y-manifold body 32, the chances of getting the entrances of the shunts system plugged by gravel deposition on the face of the Y-manifold 30 is substantially decreased. The uniquely designed Y-manifold 30 also reduces the possibility of having gravel deposition inside the main body 32 of the Y-manifold 30 before substantial flow is diverted within.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for gravel packing, comprising:

a Y-manifold having a main manifold body, a plurality of exit end shunt connectors extending from the main manifold body, and a plurality of entrance end shunt connectors extending from the main manifold body in a direction generally opposite that of the plurality of exit end shunt connectors;

a first shunted blank pipe having a plurality of first blank pipe shunt tubes twisted along a length of the first shunted blank pipe to achieve a full circumference spacing, the first blank pipe shunt tubes being coupled to the plurality of entrance end shunt connectors via a plurality of first jumper tubes, the first shunted blank pipe being positioned to deliver a gravel slurry into the Y-manifold;

a second shunted blank pipe having a plurality of second blank pipe shunt tubes, the second blank pipe shunt tubes being coupled to the plurality of exit end shunt connectors via a plurality of second jumper tubes, the second shunted blank pipe being positioned to receive the gravel slurry from the Y-manifold; and wherein the system has an eccentric configuration and the plurality of first blank pipe shunt tubes progressively decreases in flow through area with respect to the full circumference spacing to accommodate the eccentric configuration of the system.

2. The system as recited in claim 1, wherein the plurality of exit end shunt connectors comprises two exit end shunt connectors.

3. The system as recited in claim 2, wherein the Y-manifold comprises two independent commingling volumes, and wherein each independent commingling volume feeds into one of the two exit end shunt connectors for transportation to at least one of a screen system, a blank pipe, and a transport tube system.

4. The system as recited in claim 2, wherein the Y-manifold comprises a single commingling volume that feeds into both of the exit end shunt connectors for transportation to at least one of a screen system, a blank pipe, and a transport tube system.

5. A system for gravel packing, comprising:

a Y-manifold comprising:

a main manifold body; and a plurality of exit end shunt connectors extending from the main manifold body;

a shunted blank pipe having a plurality of blank pipe shunt tubes affixed along a length thereof and twisted along the length of the shunted blank pipe to achieve a full circumference spacing, each blank pipe shunt tube having an alternate path entrance at a first end of the blank pipe shunt tube for receiving a gravel slurry and a second end that exits into the Y-manifold;

wherein the plurality of exit end shunt connectors enable connection with jumper tubes at a position separated from the main manifold body; and wherein the system has an eccentric configuration and the plurality of blank pipe shunt tubes progressively decreases in flow through area with respect to the full circumference spacing to accommodate the eccentric configuration of the system.

6. The system as recited in claim 5, wherein the plurality of exit end shunt connectors comprises two exit end shunt connectors.

7. The system as recited in claim 6, wherein the Y-manifold comprises two independent commingling volumes, and wherein each independent commingling volume feeds into one of the two exit end shunt connectors for transportation to at least one of a screen system, a blank pipe, and a transport tube system via the jumper tubes.

8. The system as recited in claim 6, wherein the Y-manifold comprises a single commingling volume that feeds into both of the exit end shunt connectors for transportation to at least one of a screen system, a blank pipe, and a transport tube system.

* * * * *